US006637590B1

(12) United States Patent
Matsuki

(10) Patent No.: US 6,637,590 B1
(45) Date of Patent: Oct. 28, 2003

(54) GOLF BAG

(75) Inventor: Masanobu Matsuki, Shizuoka (JP)

(73) Assignee: Chubu Sogyo Co., Ltd., Shizuoka (JP)

( * ) Notice: Subject to any disclaimer, the term of this patent is extended or adjusted under 35 U.S.C. 154(b) by 0 days.

(21) Appl. No.: 10/252,424

(22) Filed: Sep. 24, 2002

(51) Int. Cl.[7] ..... A63B 55/00
(52) U.S. Cl. ..... 206/315.5; 206/315.3
(58) Field of Search ..... 206/315.3, 315.5

(56) References Cited

U.S. PATENT DOCUMENTS 4,142,563 A * 3/1979 Ackerfeldt et al. .. 206/315.5 X
4,263,950 A * 4/1981 Brown ..... 206/315.5
4,858,761 A * 8/1989 Fumia ..... 206/315.5 X
5,314,063 A * 5/1994 Lee et al. ..... 206/315.5 X
5,465,839 A * 11/1995 Gretz ..... 206/315.5 X
5,472,084 A * 12/1995 Aliano, Jr. ..... 206/315.3
6,478,151 B1 * 11/2002 Schmidt et al. ..... 206/315.5
6,499,593 B1 * 12/2002 Uner et al. ..... 206/315.3

FOREIGN PATENT DOCUMENTS

WO 9118650 * 12/1991 ..... 206/315.3

* cited by examiner

*Primary Examiner*—Sue A. Weaver
(74) *Attorney, Agent, or Firm*—Kanesaka & Takeuchi

(57) ABSTRACT

The invention presents a golf bag which golf articles can be easily put in or taken out, by moving the mounting position of an enclosure of a golf bag to a position easy to use by the golf players, when playing golf by laying down golf bags on a golf cart. A golf bag A comprises a golf bag main body 1 accommodating golf clubs b in its inside, and an enclosure 2 attached to the outside of the golf bag main body 1, in which the enclosure 2 is provided movably in the height direction of the golf bag main body 1 by means of position converting means 8 provided at the outside of the golf bag main body 1.

4 Claims, 10 Drawing Sheets

GOLF BAG

BACKGROUND OF THE INVENTION

1. Field of the Invention

The present invention relates to a golf bag to be handled easily when putting golf articles in and out of the enclosure of the golf bag.

2. Description of the Related Art

When playing golf, recently, golf players move around the golf course by using a golf cart, and usually, as shown in FIG. 10, golf bags 52 for three or four players are put on a rear platform 51 of a golf cart 50.

During play of golf, golf balls, tees and other articles are often taken out of or put in a pocket 53 of the golf bag 52.

However, since the pocket 53 is fixed to the outer lower part of the golf bag 52, and further the pocket 53 is positioned far ahead of the rear platform 51 of the golf cart 50 as shown in FIG. 10, when putting in or out the golf articles, the pocket 53 was far away from the reach of the hands of the golf players owing to the intervening obstacles such as golf clubs 54 in the golf bag 52.

It is more difficult to reach for short golf players or women caddies, and when golf bags 52 for three or four players are loaded, they cannot be reached from both sides of the rear platform 51 of the golf cart 50, and the pocket 53 cannot be used in the golf bag 52 placed at the inner side.

The invention is devised to solve the above problems, and it is an object of the invention to provide a golf bag comprising a golf bag main body accommodating a multiplicity of golf clubs, and an enclosure attached to the outside of the golf bag main body, in which the enclosure is provided movably in the height direction of the golf bag main body by means of position converting means provided at the outside of the golf bag main body, and therefore when playing golf by loading golf bags on a golf cart, the fitting position of the enclosure of the golf bag is moved to a position accessible for the golf player, so that the golf articles can be put in and out easily.

SUMMARY OF THE INVENTION

To achieve the object, the invention is realized by a configuration of a golf bag, the golf bag comprising a golf bag main body accommodating a multiplicity of golf clubs, and an enclosure attached to the outside of the golf bag main body, in which the enclosure is provided movably in the height direction of the golf bag main body.

The invention further features configuration of a golf bag, the golf bag comprising a golf bag main body accommodating a multiplicity of golf clubs, and an enclosure attached to the outside of the golf bag main body, in which the enclosure is provided movably in the height direction of the golf bag main body by means of position converting means provided at the outside of the golf bag main body.

Preferably, the position converting means comprises a supporting element fitted to the outside of the golf bag main body, and a working element fitted to this supporting element rotatably in the height direction of the golf bag main body through a rotary shaft provided at its base, and having an end rotatably fitted to the enclosure.

Preferably, the position converting means comprises a guide element provided in the height direction of the golf bag main body at the outside of the golf bag main body, and a sliding element provided in the enclosure and slidably engaged with the guide element.

Preferably, the position converting means is a fastener, which fixes and positions the enclosure at a proper position in the height direction of the golf bag main body by engagement of its teeth and slide.

DESCRIPTION OF THE PREFERRED EMBODIMENTS

Figure 1:
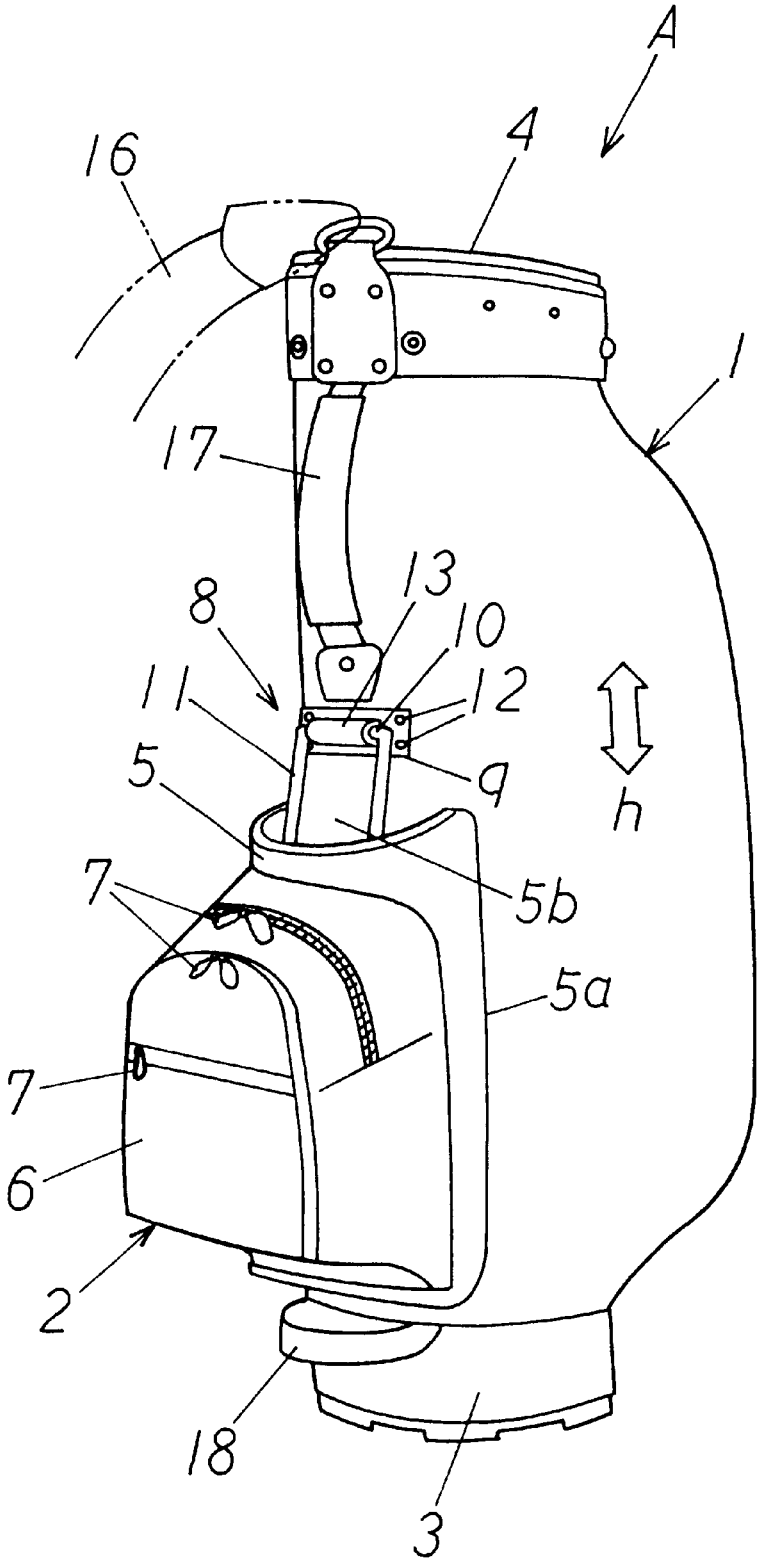
FIG. 1 is a perspective view showing a first embodiment of a golf bag according to the invention.

Preferred embodiments of the golf bag of the invention are explained by referring to accompanying drawings.

In FIGS. 1 to 3 and FIGS. 5 to 7, reference A is a golf bag, which basically comprises a golf bag main body 1 accommodating a multiplicity of golf clubs b, and an enclosure 2 attached to the outside of this golf bag main body 1.

The golf bag main body 1 is a tubular form having a bottom 3, and a multiplicity of various golf clubs bare put vertically inside from an upper opening 4.

The enclosure 2 is composed of a frame 5 and a bag 6, and the frame 5 is a semitubular form, and both ends 5*a*, 5*a* in the length direction abut against the outer side of the golf bag main body 1, and a hollow space 5*b* of specified tunnel shape is formed between the inner side of the frame 5 and the outer side of the golf bag main body 1.

The bag 6 is partitioned into plural sections, and golf gloves, golf balls, tees, and other golf articles (not shown) are put in each section depending on the accommodating space or purpose, and the opening of each section is freely opened or closed by an opening member 7 such as fastener.

The enclosure 2 is provided movably in the height direction of the golf bag main body 1 (the direction indicated by arrow h in FIG. 1), by means of position converting means 8 provided at the outer side of the golf bag main body 1.

A first example of this position converting means 8 is shown in FIGS. 1 to 4, and comprises a supporting element 9 provided at the outside of the golf bag main body 1, and a working element 11 fitted to this supporting element 9 rotatably in the height direction of the golf bag main body 1 through a rotary shaft 10 provided at its base, and having other end rotatably fitted to the enclosure 2.

The supporting member 9 is formed in a plate to conform to the outer shape of the golf bag main body 1, and is fixed to the outer side of the golf bag main body 1 by means of fixing means 12 such as screws and rivets, and a bearing 13 projects on the outer side.

Figure 4:
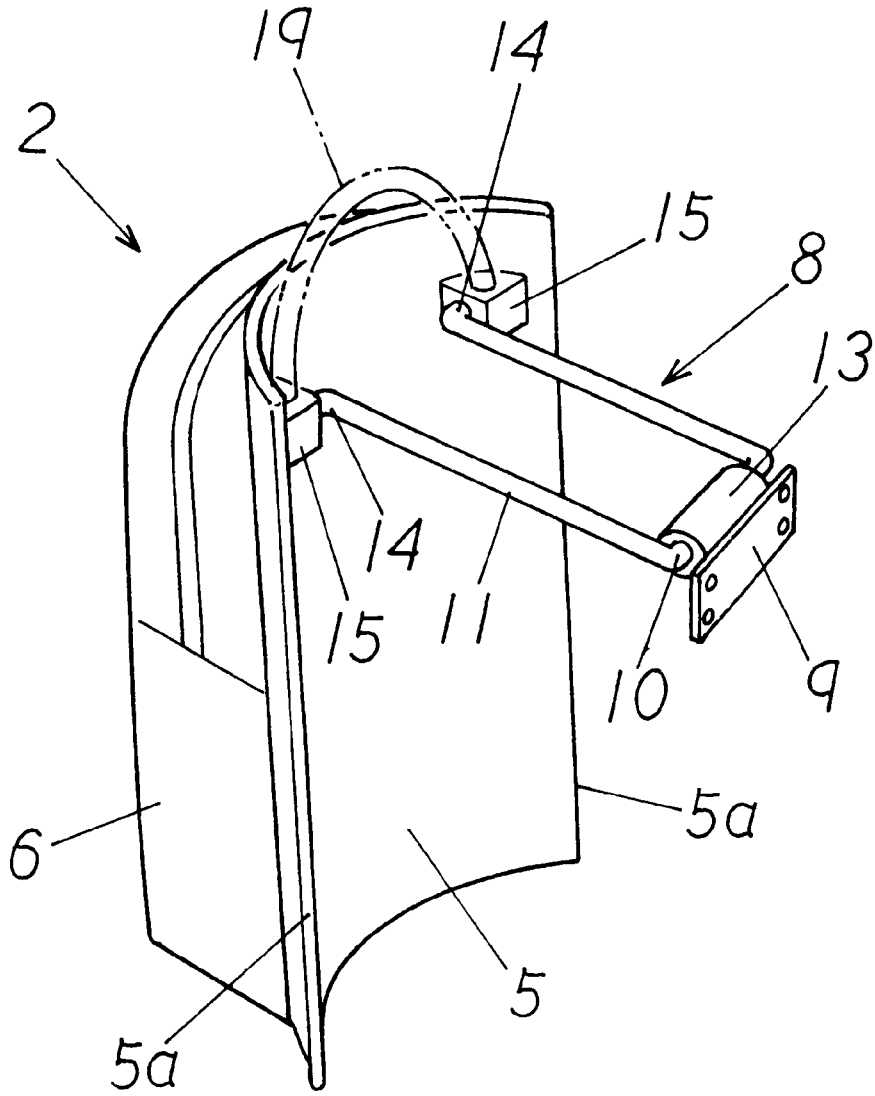
FIG. 4 is a perspective view showing position converting means provided in an enclosure in FIG. 1.

The working element 11 is a bifurcate lever, and its rotary shaft 10 is fitted to the bearing 13 of the supporting element 9, and stopping elements 14, 14 at other end are fitted to receiving members 15, 15 affixed to the inside of the frame 5 in the enclosure 2 as shown in FIG. 4.

Figure 3:
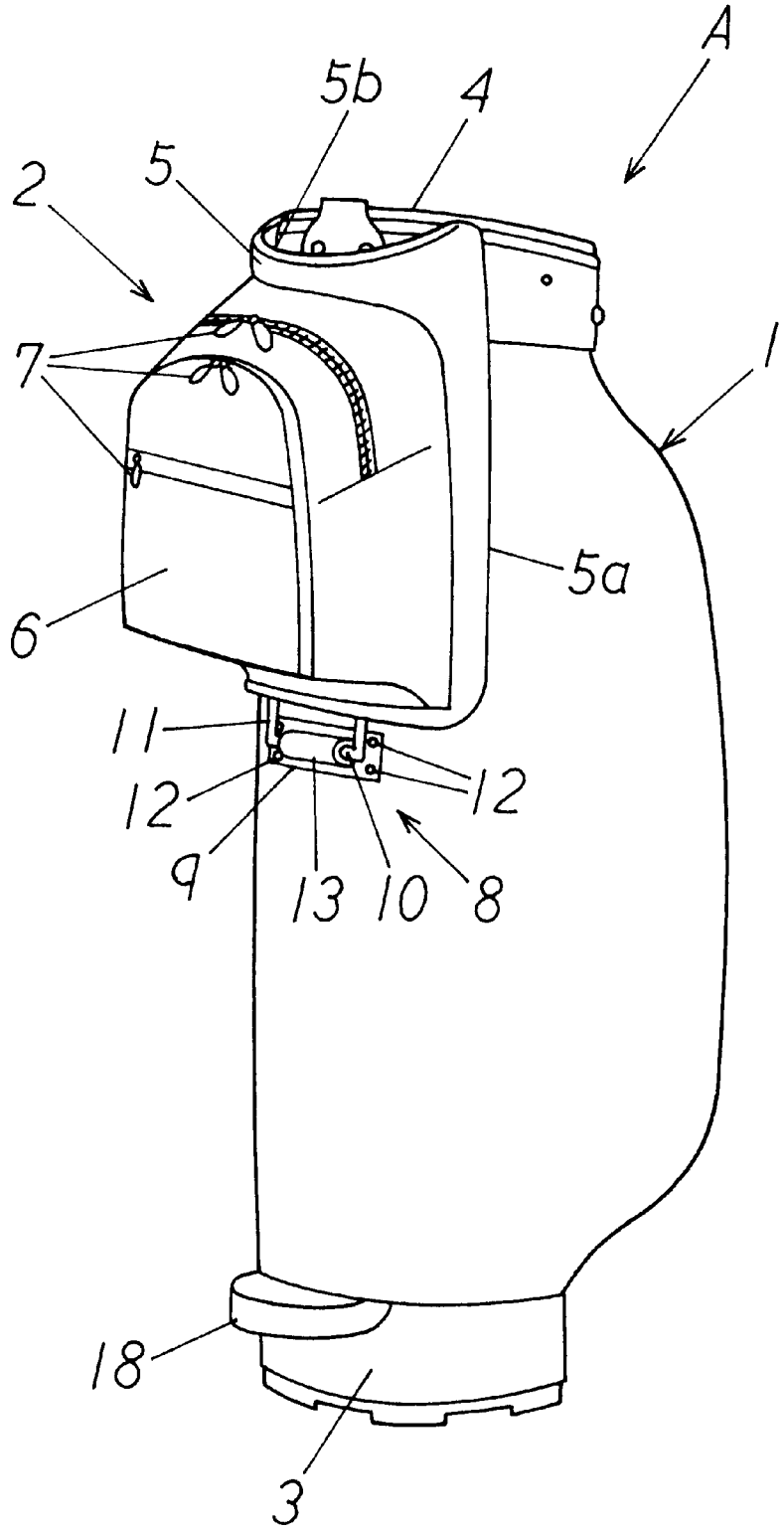
FIG. 3 is a perspective view a state after moving of the golf bag in FIG. 1.

Therefore, as shown in FIG. 1, when the enclosure 2 is at the lower position of the golf bag main body 1, the working element 11 in the position converting means 8 receives the weight of the enclosure 2 and is suspended, or, as shown in FIG. 3, when the enclosure 2 is at the upper position of the golf bag main body 1, the enclosure 2 is supported by the working element 11 in the position converting means 8.

Figure 2:
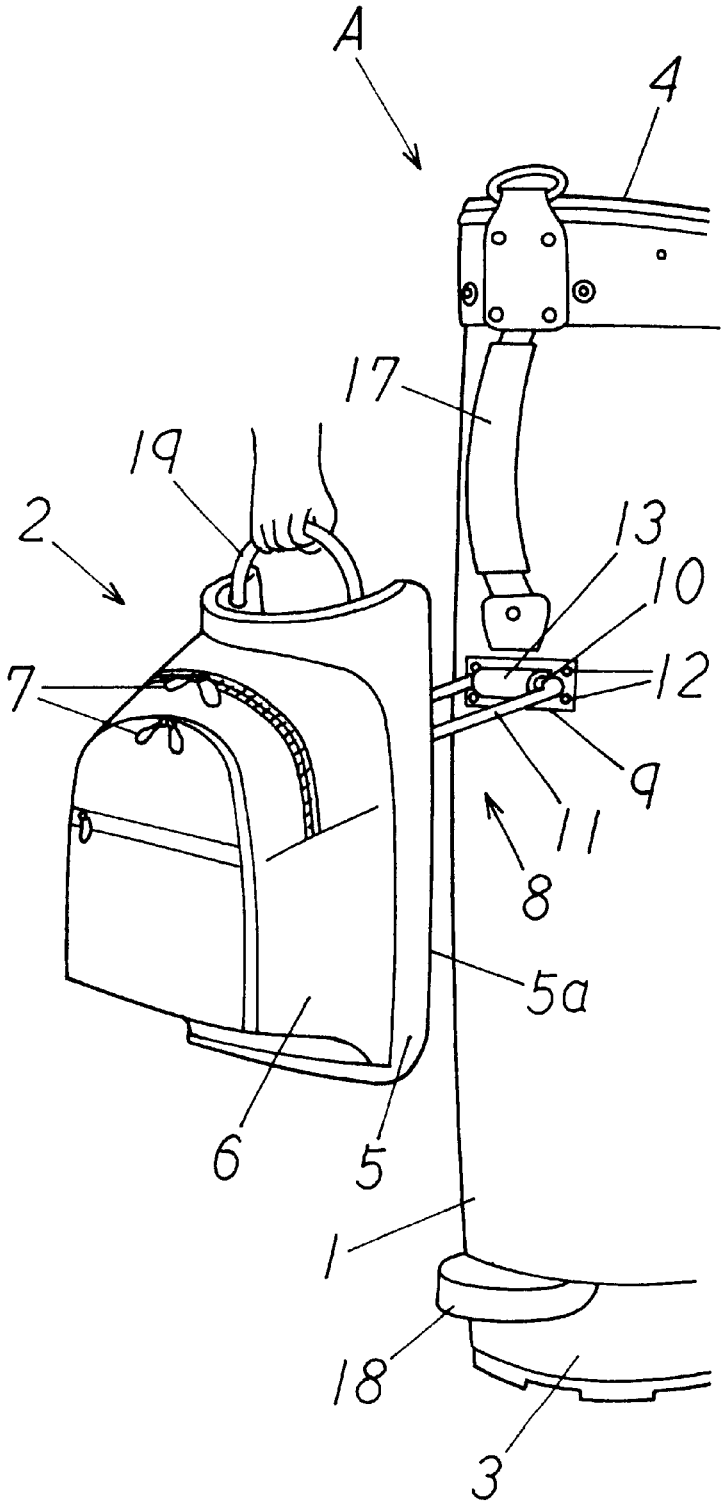
FIG. 2 is a perspective view showing a moving state of the golf bag in FIG. 1.

Such rotating action of the enclosure 2 may be done easily by using a handle 19, and the handle 19 is fitted to the frame 5, for example, as shown in FIG. 2 or FIG. 4.

Corresponding to the position of the enclosure 2, as indicated by virtual line in FIG. 1, a shoulder strap 16 is provided along the height direction of the golf bag main body 1, and its ends are fitted with clamps (not shown) at the upper part (opening 4 peripheral edge) in the golf bag main body 1 and the middle part of the golf bag main body 1.

By putting the shoulder strap 16 on the shoulder, a relatively heavy golf bag A can be carried easily, or it may be also carried easily by a handle 17 provided near the shoulder strap 16 or by handle 18 in the lower part.

The shoulder strap 16, when in use, projects outward from the golf bag main body 1, and while not in use, it is partly stowed away in the hollow space 5*b* in the frame 5 of the enclosure 2 to be flush with the side of the golf bag main body 1, and there is no protruding portion, and the shoulder strap 16 does not interfere when putting golf articles in and out of the bag 6.

That is, the shoulder strap 16 is retractably in the hollow space 5*b*, and the axial direction of an umbrella not shown corresponds to the hollow space 5*b*.

Therefore, as mentioned above, the golf bag A of the first embodiment of the invention brings about the following effects, and when carrying the golf bag A, the enclosure 2 is rotated by the position converting means 8 so as to be positioned in the lower part of the golf bag main body 1 as shown in FIG. 1, and it can be carried relatively easily by using the shoulder strap 16 or handle 17.

Further, when the enclosure 2 is in the lower part, the position of the center of gravity of the golf bag main body 1 packed with golf clubs b is relatively lower, and the golf bag A is maintained stably even when standing straight.

Figure 5:
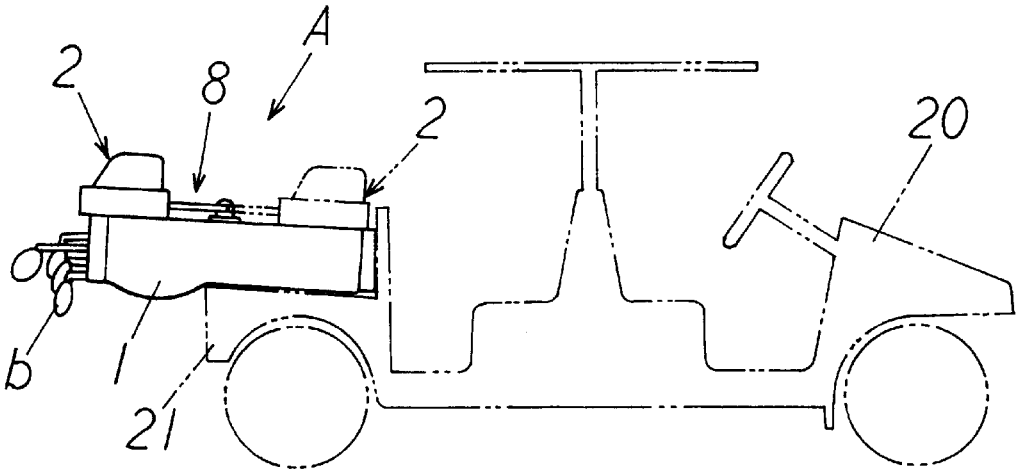
FIG. 5 is an explanatory diagram showing a state of a golf bag of FIG. 1 put on a golf cart.

When playing golf, a plurality of (usually four) golf bags A are laid down side by side on a rear platform 21 of a golf cart 20 with the enclosure 2 upward as shown in FIG. 5, and the enclosure 2 is positioned in the upper part (near the opening 4) of the golf bag main body 1 preliminarily as shown in FIG. 3.

This process is to rotate the enclosure 2 by the position converting means 8 in the state of the golf bag main body 1 at the lower position shown in FIG. 1, and when the enclosure 2 is pulled by holding the handle 19 of the frame 5, the enclosure 2 rotates about the rotary shaft 10 of the working element 11, and the frame 5 is lifted upward as departing from the outer side of the golf bag main body 1 as shown in FIG. 2, and when the enclosure 2 is further lifted, as shown in FIG. 3, the enclosure 2 is moved closer to the opening 4 in the golf bag main body 1, so that the frame 5 abuts against the outer side of the golf bag main body 1.

In this state, when the golf bag A is put on the rear platform 21 of the golf cart 20 with the enclosure 2 at the upper side, the enclosure 2 is at a position projecting from the rear platform 21 to the outer side as shown in FIG. 5, and therefore when golf balls or other golf articles are needed during golf play, the golf clubs b contained in the golf bag main body 1 do not interfere, and they can be easily taken out or put back in the enclosure 2.

The enclosure 2 can be fixed by any desired fixing means (not shown) such as fastener or hook.

A second embodiment of golf bag A of the invention is explained by referring to FIGS. 6 to 9.

This embodiment shows other example of position converting means 8, and the position converting means 8 comprises a guide element 22 fitted in the height direction (the direction indicated by arrow h in FIG. 1) of the golf bag at the outer side of the golf bag main body 1, and a sliding element 23 fitted to the enclosure 2 and slidably engaged with the guide element 22.

In this golf bag 1, the composition of the golf bag main body 1 and enclosure 2 is same as in the first embodiment, and same members are identified with same reference numerals and same explanation as in the first embodiment is omitted.

Figure 8:
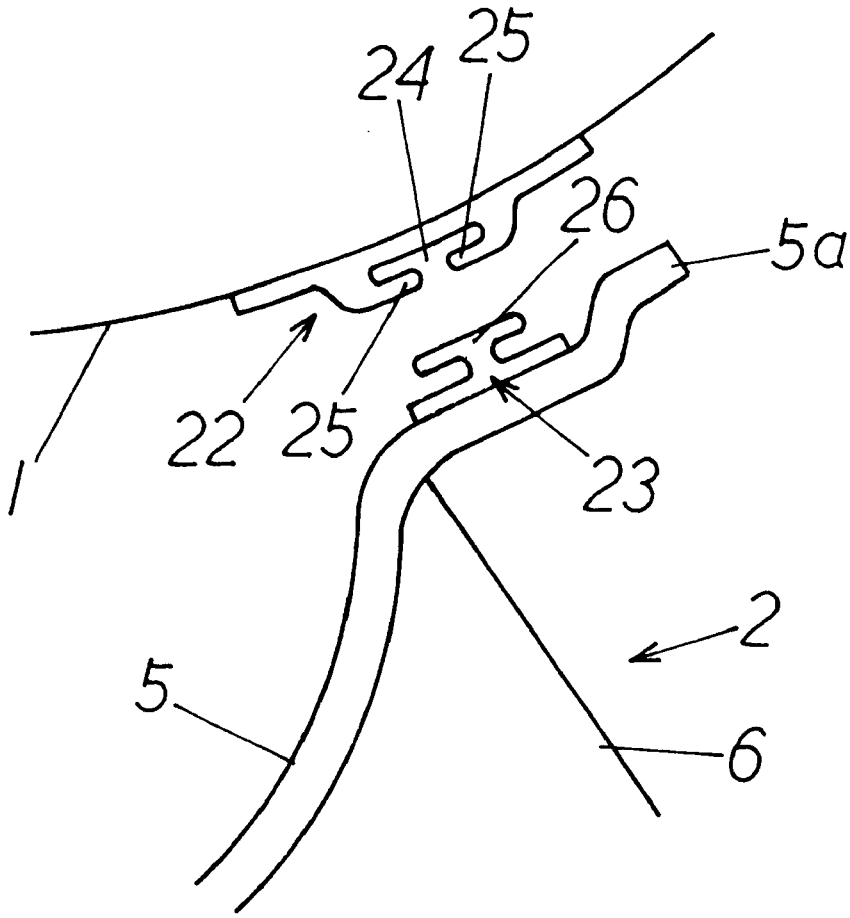
FIG. 8 is a plan view showing essential parts of position converting means provided in an enclosure in FIG. 6.

The guide member 22 has a concave groove 24 extending in the height direction of the golf bag main body as shown in FIG. 8, and locking edges 25 are provided at both edge portions of the groove 24.

The sliding element 23 has a T-shaped bump 26 to be inserted into the groove 24 of the guide element 22 as shown in FIG. 8, and by the sliding engagement of the groove 24 and sliding element 23, it can be freely moved and fixed at arbitrary position in the height direction of the golf bag main body 1.

Figure 9:
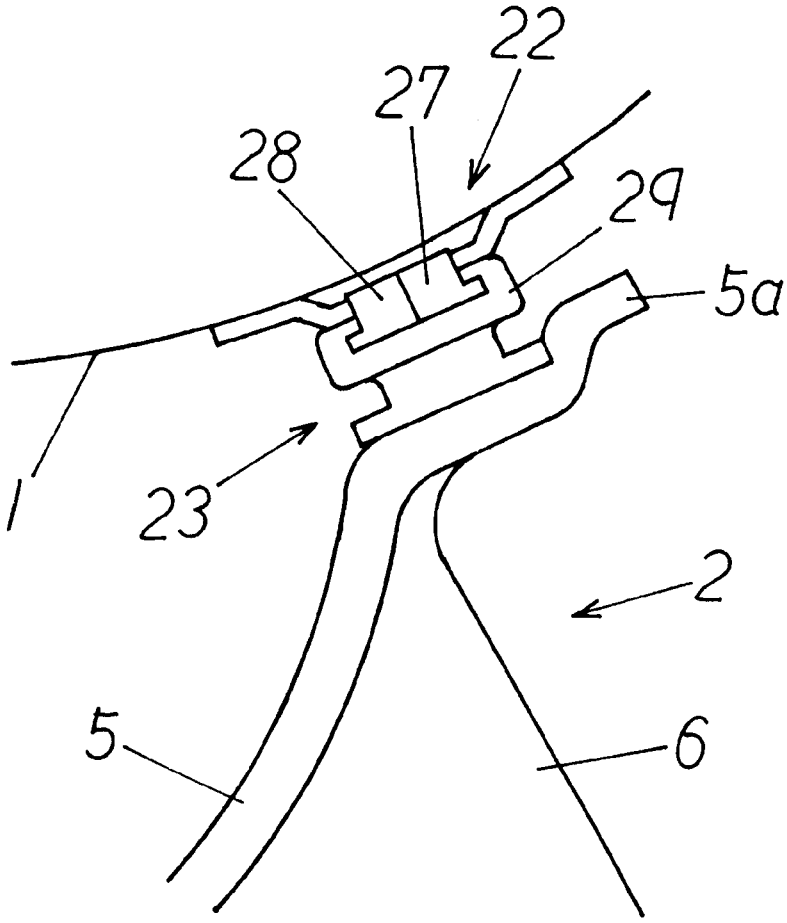
FIG. 9 is a plan view showing other example of position converting means in FIG. 1.
Figure 10:
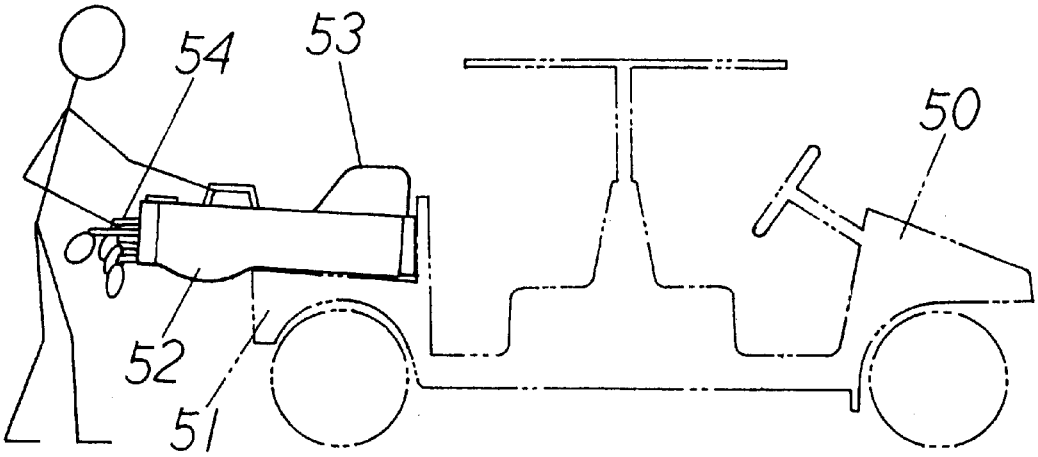
FIG. 10 Prior Art
FIG. 10 is an explanatory diagram showing a state of a conventional golf bag put on a golf cart.

In this embodiment, the position converting means 8 may be a fastener or zipper, as shown in FIG. 9, consisting teeth 27, 28 fitted to a tape used as the guide element 22, and a slide 29 or the sliding element 23, and the tape of the teeth 27, 28 is provided in the height direction of the golf bag main body 1, and the slide 29 to be engaged with the teeth 27, 28 is fitted to the inside of the frame 5 in the enclosure 2.

In the case of the fastener type position converting means 8, by the engagement of the teeth 27, 28 and the slide 29, the enclosure 2 can be moved to a proper position in the height direction of the golf bag main body 1, and the enclosure 2 of the golf bag main body 1 may be pulled up within the reach of the user depending on the convenience of the user. Such effects and actions are similarly exhibited in the slider type position converting means 8 shown in FIGS. 6 to 8.

Figure 6:
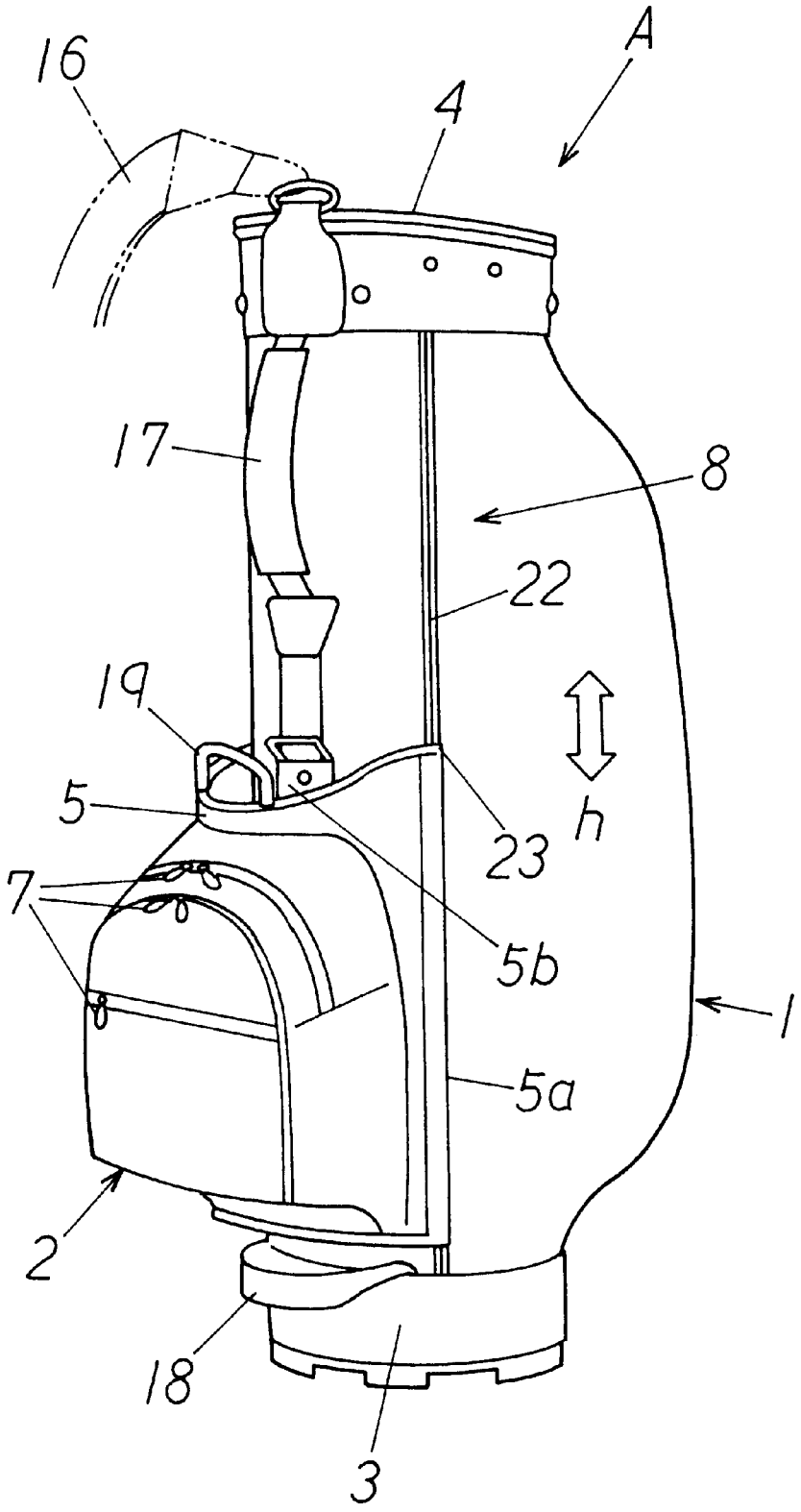
FIG. 6 is a perspective view showing a second embodiment of a golf bag according to the invention.

Therefore, when carrying the golf bag A, by the position converting means 8, the enclosure 2 can be moved to a lower position of the golf bag main body 1 as shown in FIG. 6, so that it can be carried relatively easily by using the shoulder strap 16 or handle 17.

Further, when the enclosure 2 is in the lower part, the position of the center of gravity of the golf bag main body 1 packed, with golf clubs b is relatively lower, and the golf bag A is maintained stably if standing up.

Figure 7:
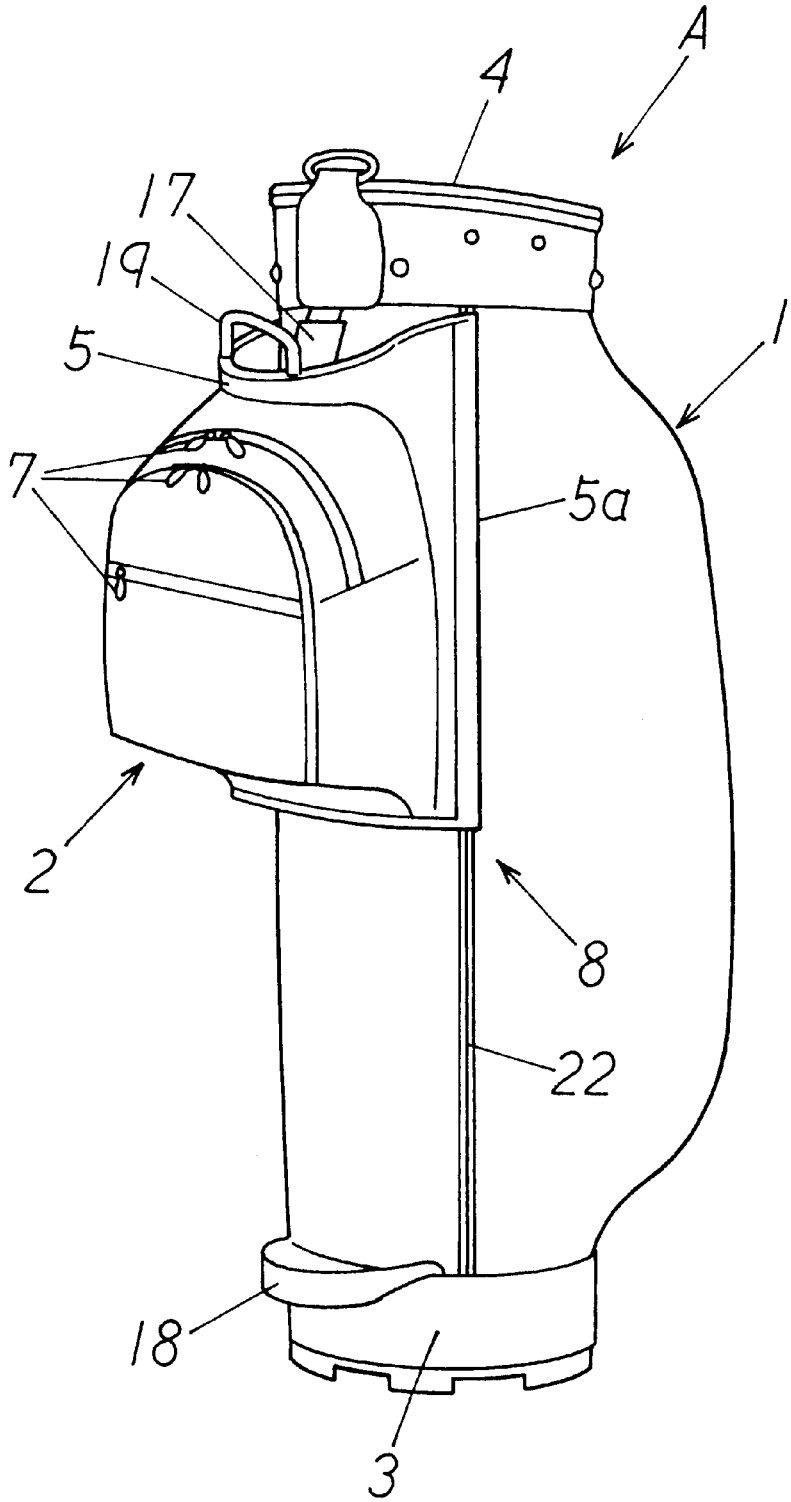
FIG. 7 is a perspective view showing a state after moving of the golf bag in FIG. 6.

For playing golf, a plurality of (usually four) golf bags A are laid down side by side on a rear platform 21 of a golf cart 20 with the enclosure 2 upward as shown in FIG. 5, and the enclosure 2 is preliminarily positioned in the upper part (near the opening 4) of the golf bag main body 1 as shown in FIG. 7.

This process is to move the enclosure 2 by the position converting means 8 in the state of the golf bag main body 1 at the lower position shown in FIG. 6, and when the enclosure 2 is pulled by holding the handle 19 of the frame 5, the enclosure 2 is moved as its sliding element 23 slides toward the opening 4 along the guide element 22.

Then, as shown in FIG. 7, when the closure 2 is moved closer to the opening 4 in the golf bag main body 1, pulling of the handle 19 is stopped.

In this state, when the golf bag A is put on the rear platform 21 of the golf cart 20 with the enclosure 2 at the upper side, the enclosure 2 is at a position projecting from the rear platform 21 to the outer side as shown in FIG. 5, and therefore when golf balls or other golf articles are needed during golf play, the golf clubs b contained in the golf bag main body 1 do not interfere, and they can be easily taken out or put back in the enclosure 2.

The enclosure 2 can be fixed by any desired fixing means (not shown) such as fastener or hook.

As described herein, according to the invention, since the enclosure containing golf articles is provided movably in the height direction of the golf bag main body, when the golf bag main body is set upright, the enclosure is positioned downward and stands stably, or when laid down on a golf cart, the enclosure can be positioned within the reach of the golf players, so that the golf particles in the enclosure can be taken out or put in easily and promptly. And many other outstanding effects are brought about.

What is claimed is:

1. A golf bag comprising:

a golf bag main body for accommodating a multiplicity of golf clubs, an enclosure attached to an outside of the golf bag main body, and position converting means provided at the outside of the golf bag main body for moving the enclosure in a height direction of the golf bag main, said position converting means including a supporting element fitted to the outside of the golf bag main body, and a working element having a rotary shaft rotatably fitted to the supporting element to rotate the working element in the height direction and an end rotatably fitted to the enclosure.

2. A golf bag according to claim 1, wherein said enclosure includes a frame rotatably attached to the end of the working element, and a handle attached to the frame.

3. A golf bag comprising:

a golf bag main body for accommodating a multiplicity of golf clubs, an enclosure attached to an outside of the golf bag main body, and position converting means provided at the outside of the golf bag main body for slidably moving the enclosure in a height direction of the golf bag main body, said position converting means being formed of a sliding fastener having a tape with teeth engaging with each other, said tape being fixed to the golf bag main body to extend in the height direction, and a slide slidably engaging the tape with the teeth and fixed to the enclosure so that the enclosure can be moved and located at a proper position in the height direction by movement of the slide along the tape.

4. A golf bag according to claim 3, wherein said enclosure includes a frame, to an inner side of which said slide is fixed, and a handle attached to the frame.

* * * * *